United States Patent [19]

Faust

[11] 4,138,673

[45] Feb. 6, 1979

[54] SMALL SIREN HAVING PROTECTIVE SCREEN

[75] Inventor: James H. Faust, Cicero, Ill.

[73] Assignee: A B C Auto Alarms, Inc., Elk Grove Village, Ill.

[21] Appl. No.: 841,120

[22] Filed: Oct. 11, 1977

[51] Int. Cl.[2] ..... G10K 7/04

[52] U.S. Cl. ..... 340/405; 116/147

[58] Field of Search ..... 116/147; 46/179; 340/405

[56] References Cited

U.S. PATENT DOCUMENTS

| | | | |
|---|---|---|---|
| 1,428,684 | 9/1922 | Erick | 340/405 |
| 2,015,387 | 9/1935 | Seiss | 116/147 |
| 2,172,413 | 9/1936 | Scott | 340/405 |
| 2,528,515 | 11/1950 | Heigis | 116/147 |
| 3,121,220 | 2/1964 | Buckwalter | 116/147 |
| 3,991,703 | 11/1976 | Faust | 116/147 |

FOREIGN PATENT DOCUMENTS

| | | | |
|---|---|---|---|
| 405649 | 1/1910 | France | 116/147 |

*Primary Examiner*—S. Clement Swisher
*Assistant Examiner*—Denis E. Corr
*Attorney, Agent, or Firm*—Silverman, Cass & Singer, Ltd.

[57] ABSTRACT

A siren for an alarm adapted to be driven by a fractional horsepower motor and provided with a cup shaped rotor cooperating with a stator provided with perforations in the cylindrical flange thereof, and a drawn, cup-shaped screen or grille seated over the inlet to said stator and having a cylindrical flange extending over the perforations of the stator but spaced outwardly therefrom, the base of the screen being engaged on the stator rim. The intake air flow of the siren is restricted by the perforations of the screen which increases the velocity of the intake air, thereby increasing the efficiency of the siren which enables reduction of the current usage requirements. The harmonics of the output sound are increased by the perforated cylindrical flange of the screen thereby increasing the volume and pitch of the emitted sound.

16 Claims, 5 Drawing Figures

FIG. 1
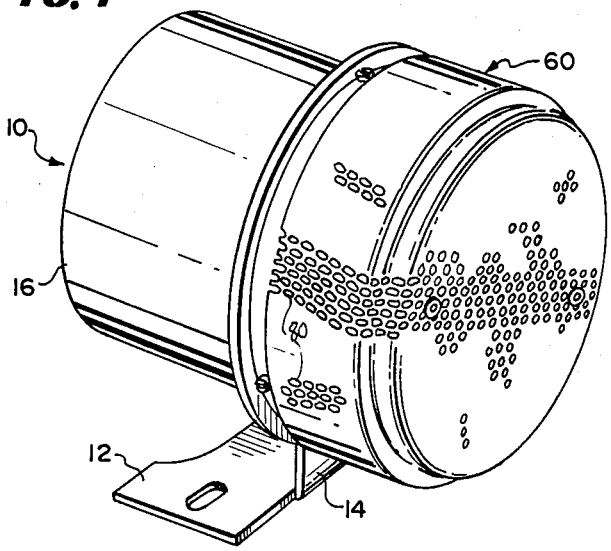
FIG. 2
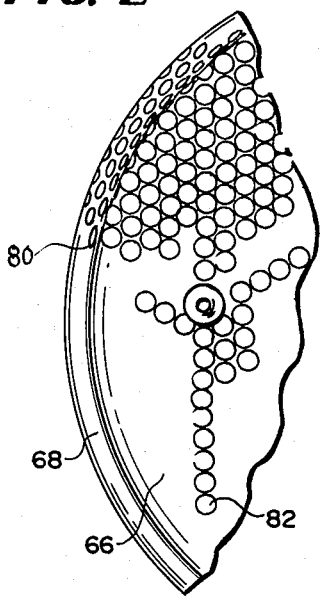
FIG. 3
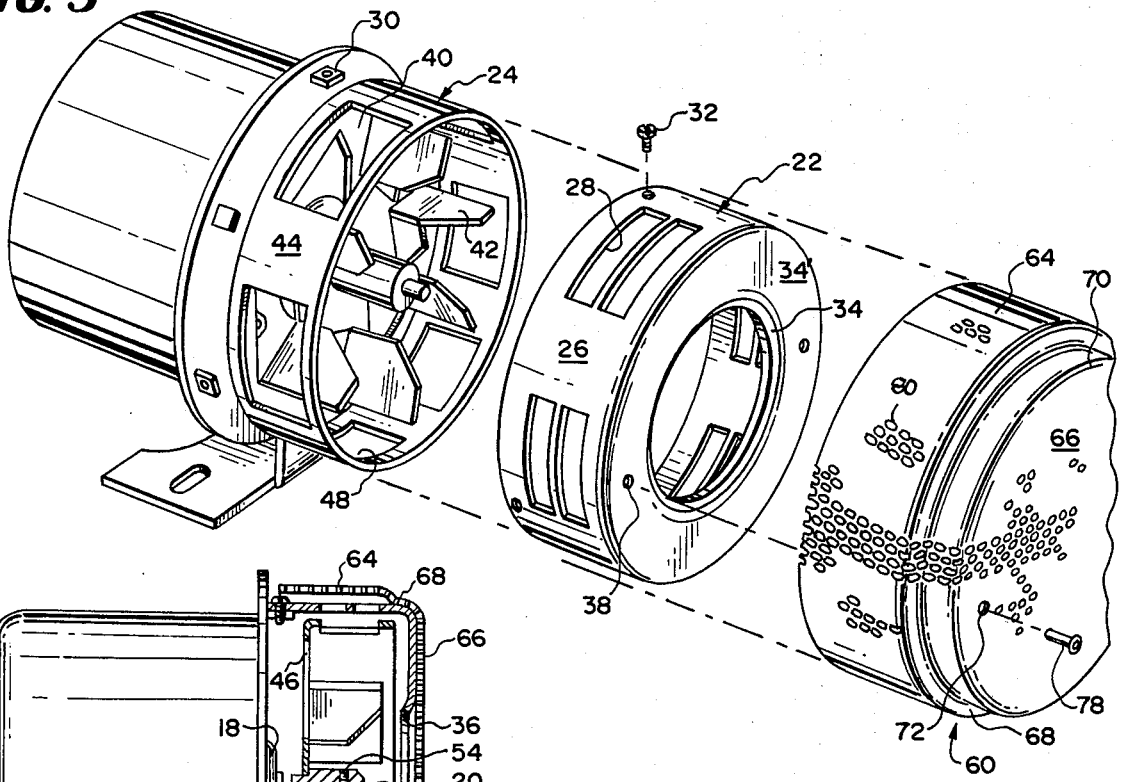
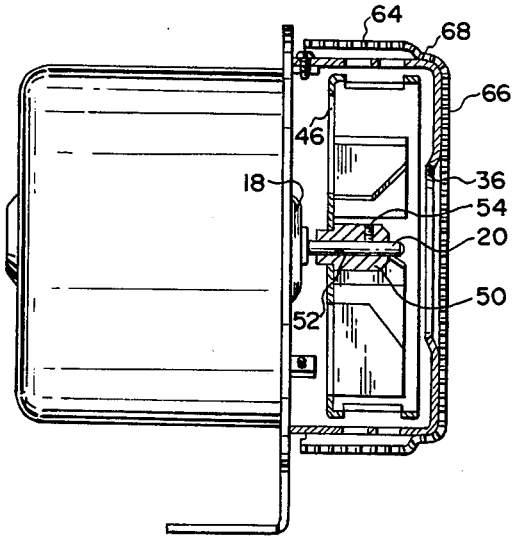
FIG. 4

SMALL SIREN HAVING PROTECTIVE SCREEN

FIELD OF THE INVENTION

This invention relates generally to small sirens for use primarily in domestic installations where the small siren is to be driven by a fractional horsepower motor, and most particularly is concerned with small sirens used as automobile theft alarms and providing these type sirens with a protective screen capable of preventing access to the interior of the siren while increasing the operating efficiency of the siren and improving the effectiveness of the sound output thereof.

BACKGROUND OF THE INVENTION

Alarms of the type concerned herein are known generally and comprise relatively simple structures. There is a bracket which mounts the motor and may carry electric terminals, switches, etc. mounted thereon. The shaft of the motor protrudes through a support plate and a generally cup-shaped housing or casing is mounted on the support plate co-axially with the shaft. The casing shall be referred to as the stator of the siren. The outer annular flange of the stator has a plurality of perforations intended for cooperation with similar perforations provided on the siren rotor which is mounted on the shaft within the cup-shaped stator. In addition to perforations on the cylindrical wall of the rotor, vanes are provided to promote movement of air through the device thereby creating the turbulence which produces the high-pitched sound desired. One example of such a siren is described in U.S. Pat. No. 3,991,703 owned by the assignee hereof.

Generally, the stator is of cylindrical configuration and provides a cylindrical flange in which the slots or perforations are punched during manufacture. One end of the stator is open so that the stator may be fitted over the rotor. The other end has an annular baffle integral with the flange. Air is intended to be drawn through the stator, channeled by the baffle. The baffle extends radially inward and funnels into the center of the stator when the assembly of stator and rotor is effected. An annular rim is provided which may include an annular recessed portion linking the cylindrical flange to the baffle. The stator may comprise a cylindrical tube carrying the slots and a cup-shaped cap carrying the annular baffle and seated over one end of the tube to complete the assembly of the stator.

Alarms of the type concerned herein are intended to be installed quickly and economically, and are intended to be accessible to the owner or service man during installation, removal, testing, reinstallation and the like which may involve handling of the siren directly. Inadvertent initiation of the operation of the siren while the same is being manipulated may give rise to considerable danger to the fingers of the person handling the device such as the serviceman installing or servicing the alarm. Means for protecting the individual would be considered highly desirable if provided.

One problem with twelve volt devices used on modern automobiles is their current consumption. The desirable end is the improvement of the effectiveness without increasing current drain. Such problem involves operation thereof with the minimization of current usage without loss in effectiveness of the device.

The invention herein involves the discovery that a protective screen or grille can be provided of particular configuration which will enable the operating efficiency of the siren to be improved, provide the required protective function and, unobviously and unexpectedly, improve the harmonics of the sound output to provide emitted sound that is more piercing i.e. higher in sound power output and increased in pitch.

SUMMARY OF THE INVENTION

A siren in which the stator is formed as a cylindrical member having a perforated flange and an annular baffle at one end, the baffle defining an inlet and the perforations defining an exhaust or outlet when the stator is assembled to a rotor. A protective screen or grille of cup-shaped configuration is formed by drawing a flat mesh material of predetermined mesh size, the screen including a cylindrical flange portion and a base, and being seated over the stator with the cylindrical flange portion spaced outwardly a predetermined distance from the cylindrical flange of the stator and the base portion engaged over the baffle. The size of the perforations of the thus formed screen is selected to restrict air flow into the siren, reducing the current required to operate the siren by effectively increasing the velocity of the air flow. Preferably, the perforations of the annular flange are of irregular shape and size; the configuration and size thereof and the distance of the flange from the annular flange of the stator determine the effective modulation of the sound output from the exhaust openings. This increases the harmonics of said output and the pitch to produce a more piercing and effective sound.

BRIEF DESCRIPTION OF THE DRAWINGS

FIG. 1 is a perspective view of a small siren with a protective screen installed thereon according to the invention;

FIG. 2 is a fragmentary plan view of the protective screen;

FIG. 3 is an exploded perspective view of the siren illustrated in FIG. 1;

FIG. 4 is an elevational view of the small siren illustrated in FIG. 1 with the siren shown in section.

DESCRIPTION OF PREFERRED EMBODIMENTS

Figure 5:
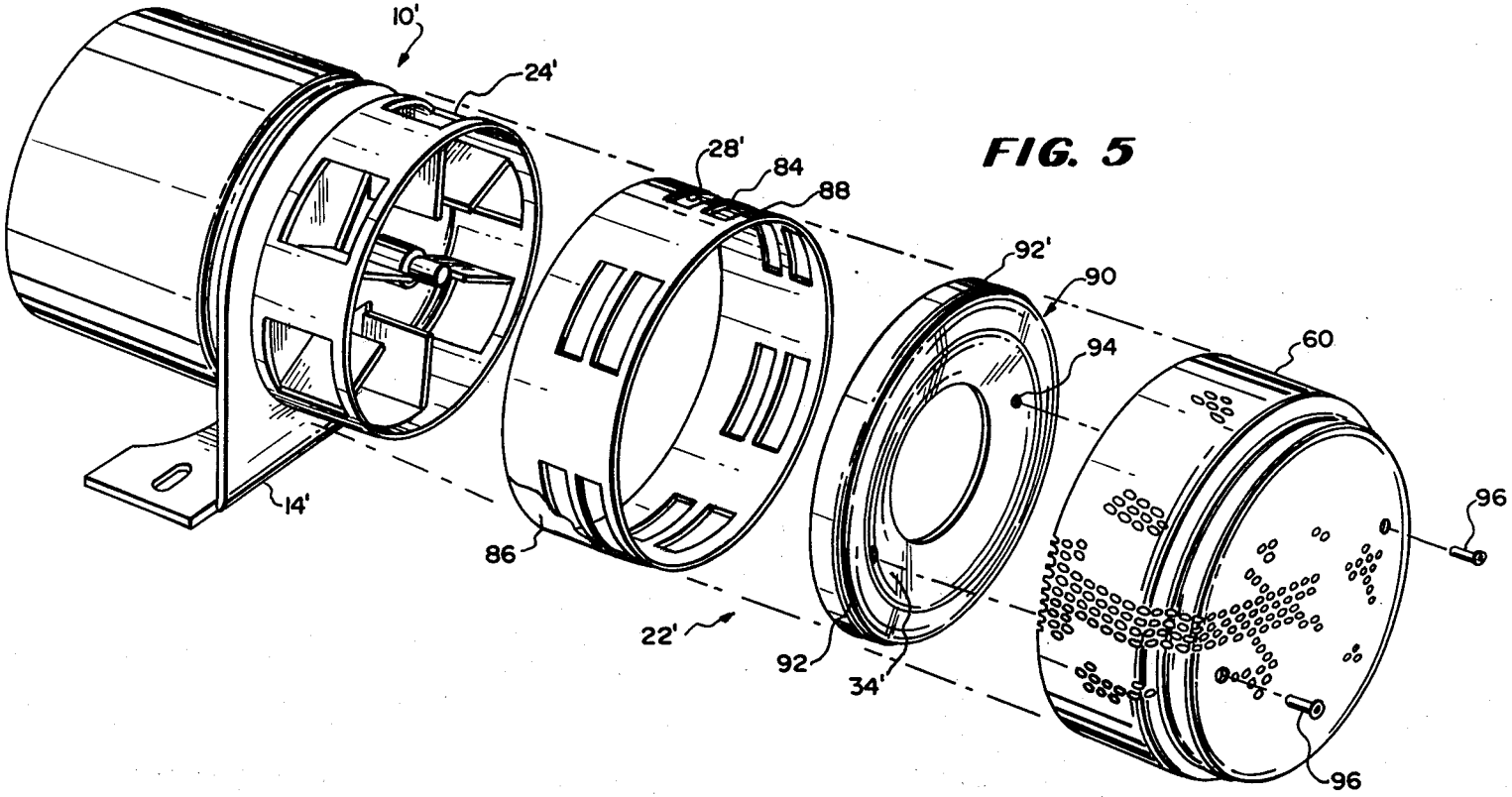
FIG. 5 is a perspective view of a modified embodiment of the invention.

The invention herein is directed to a small siren of the type driven by a fractional horsepower motor such as employed in auto alarms and the like provided with a protective screen or grille. The screen or grille is installed over the intake of the small siren with a portion of the grille disposed over the exhaust openings or perforations provided in the stator of the siren but spaced therefrom a predetermined distance. In addition to its protective function, the grille modulates the air intake and exhaust restricting the air flow, increasing turbulence and efficiency of the siren while reducing current requirements. Further, the sound produced when the screen is installed is louder and more piercing enabling improvement in the warning afforded by the alarm signal.

The siren assembly illustrated in FIG. 1 is designated generally by reference character 10. The siren assembly 10 includes a support bracket 12 provided with an upstanding plate 14. A fractional horsepower d.c. electric motor 16 is secured on one side of the plate 14 with the motor boss 18 and coaxial shaft 20 protruding through a suitable opening in the plate 14 to the opposite side of the said plate 14. A rotor 24 is mounted to the shaft 20.

The stator 22 is secured to the plate 14 coaxial with and enclosing the rotor 24.

The stator 22 has a cylindrical cup-like configuration and provides a cylindrical flange 26 in which slots or windows 28 are punched or otherwise formed during manufacture. The left-hand end of the stator 22 as viewed in the drawing is open and is engaged over the lugs 30 which are struck from and bent at right angles to the support plate 14. The lugs 30 are arranged in a circle and define precisely the location of the inner surface of the flange 26. The lugs are drilled and tapped as shown in FIG. 4 to receive mounting screws 32 passing through suitable holes in the flange 26 from the exterior thereof and engaging the threaded holes of the lugs 30. The location of the flange 26 is chosen to define a very small gap between the stator 22 and the rotor 24.

The axially outer end of the stator 22 has a central reduced diameter passageway defined by annular baffle 34 that is integral with the flange 26 and extends radially inward and then funnels into the center of the stator 22 as shown at 36. A pair of tapped holes 38 is formed in the rim or imperforate portion 34' of baffle 34 and arranged diametrically opposed one relative the other to provide for securement of the grille thereto, as will be later explained.

The rotor 24 comprises a base plate 40 which has plural vanes 42 formed therefrom and bent at right angles thereto. A cylindrical flange 44 is provided integral with the plate 40 and surrounding the base plate 40 to provide a cup-shaped configuration. The vanes 42 are bent in a direction to bring them into the interior of the cup-shaped configuration. The planes of the vanes 42 are spaced radially outward of the axis of the rotor 24. The formation of each vane 42 leaves an opening 46 of substantially the identical configuration in the base plate.

The cylindrical flange 44 of the rotor 24 is provided with rectangular arcuate slots or windows 48 aligned radially with the openings 46 and so located axially that when the siren is assembled, the slots or windows 48 will align axially with the slots or windows 28 of the stator. The circumferential spacing of the vanes 42, openings 46 and windows 48 is the same. The circumferential spacing of the windows 28 may be the same as or different from the spacing of the windows 48 of the rotor 24. The spacing is equidistant from window to window on the circumference of the rotor.

The rotor 24 had a central hub 50 staked or otherwise secured at the center thereof having a passageway 52 to accommodate the shaft 20 of the motor 16 in a close fit. A setscrew 54 holds the hub 50 and hence the rotor 24 to the shaft 20 of said motor.

The d.c. electric motor 16 drives the rotor 24 causing air to be ingested at the intake of the siren 10 defined by the baffle 34 of the stator 22. The air is accelerated by the rotation of the vanes 42 with the rotor 24 and is exhausted through the windows 28 of the stator 22 after passing through the windows 48 of the rotor and the gap between the cylindrical flanges 26 and 44 of the stator and the rotor respectively. The sound power output is related to the size of the intake aperture, the parameters of the rotor 24, i.e., gap, vanes, windows, etc., the size of the exhaust windows (windows 28) and the r.p.m. of the motor. Once designed, tooled and placed into production, changes which may result in improved sound power output are not to be expected except by complete redesign.

In such low power siren, although there is apparent need for preventing injury by covering the siren openings, one would logically conclude that a covering grille would decrease the siren efficiency. It has been discovered, however, that the particular construction and disposition of the protective barrier provided by the invention has an unexpected and unobvious advantageous effect upon the efficiency and sound output of the siren.

The invention herein contemplates the use of screening of the mesh size, configuration of openings, etc., enabling a variable restriction of the air flow which is ingested through the intake orifice of the siren. It has also been discovered that restriction of flow over a large area in lieu of the adjustment of the configuration of the baffle, i.e., the size of the intake orifice, enhances the effectiveness of the intake venturi by creating an increased velocity of the air drawn into the intake orifice of the stator. This is believed to increase the turbulence within the siren and also enable the motor to operate with the same efficiency on lower current.

The protective screen can be extended over the exhaust windows of the stator, resulting in further restriction of the exhausted air. Greater turbulence is believed to be created in a limited area producing more harmonics and hence a higher and more penetrating pitch. The spacing of the screen from the exhaust windows varies the modulation of the exhausted air, and thus varies the pitch and volume of the sound output of the siren.

Actual measurements have demonstrated that the current employed to operate the siren when the screen of the invention is installed is reduced while the sound output volume is no less, and in most instances, greater than without the screen.

The protective screen according to the invention is designated by reference character 60 and comprises a generally cylindrical cup-shaped member 62 drawn to size and shape from a sheet of mesh material preferably formed of 22 gauge cold rolled steel. Other materials which can be employed include aluminum, plastic or other suitable mesh material. A mesh having apertures greater than 0.050 inches in diameter and less than 0.250 inches in diameter was found to provide the desirable effects realized by the invention herein. The mesh size was selected to permit passage of no more than 70% of the air intake when unrestricted through the interposed screen. Preferably, a mesh size which has a 51% overall open area provided the best effects as to increased motor speed and increased siren efficiency. This mesh had holes 0.156" in diameter arranged in staggered relation on 5/32" centers. Mesh having 0.118" diameter holes also has been found to be effective.

The screen 60 has a cylindrical flange 64 and a base or floor 66 integral with the flange 64 and joined thereto by an annular recessed portion 68. The peripheral rim 70 of the floor 66 is seated upon the rim 34' of the baffle 34 when the screen 60 is assembled to the siren 10. Suitable openings 72 are formed in the base or floor 66 of the screen 60 so that fastening means, such as screws 78 may be passed therethrough and engaged in the tapped holes 38 of the stator 22.

The dimensions of the annular recessed portion determine the spacing of the cylindrical flange 64 of the screen 60 from the exhaust windows 28 of the stator 22. Preferably, the effective distance or spacing has been found to be in the range from 0.25" to 0.75". The individual apertures 80 carried by the cylindrical flange 64 of the screen 60 may differ from the apertures 82 carried by the floor 66 of said screen in size and regularity, having been distorted during the drawing process while apertures 82 are generally uniform. The specific configuration of apertures 82 is not critical. They may be circular, oval or hexagonal. The thickness of the screen used does not appear to affect the efficiency or sound output of the screen 60.

It has been found that the variable and deformed configuration of apertures 80 bears upon the modulation provided to the exhausted air flow from windows 28 of stator 22 and hence may be in part responsible for the increase in harmonics and higher pitch of the sound emanating from the siren 10 when the screen 60 is installed.

The modified embodiment 10' illustrated in FIG. 5 is similar to the siren 10 illustrated in FIGS. 1 to 4 inclusive but for the size and construction of the stator and rotor of the siren as well as the method of securing the screen 60 thereupon. In the siren assembly 10' the stator 22' is formed of two parts. The first part is an open-topped dish-shaped cup member 84 having a floor 86 and a cylindrical flange 88 carrying plural windows 28' equidistantly spaced about its circumference. The floor 86 of the cup 84 is secured to the mounting plate 14'. A cap 96 carrying an annular flange 92 is force-fitted over the open end of the cup 84. Cap 90 carries baffle 34', similar to the baffle 34 carried by stator 22. The inner diameter of the cap 86 is slightly less than the outer diameter of the cup 84 with the flange 92 having an enlarged diameter portion 92', which seats tightly engaged upon the outer circumference of the flange 88 of cup 84. A pair of tapped holes 94 is provided, screws or rivets 96 passing through the grille to engage within said holes 94 for securing the grille to the cap 90.

What I claim is:

1. In a siren which includes a fractional horsepower motor, plate means for mounting the motor with a shaft protruding, a perforated and vaned rotor mounted on the shaft, a perforated cup-shaped stator coaxial with the shaft and rotor and having perforations around the circumference thereof and an axial opening whereby an intake orifice and plural exhaust windows are defined, air being drawn through the orifice, into the interior of the siren axially and discharged radially through the perforations; the invention comprising, a protective screen secured to the siren and having a face positioned over the intake of the stator, the face having a generally uniform mesh size of which being selected to have openings having a diameter greater than 0.050 and less than 0.250 inches to restrict air intake but enabling at most 70% of the intake air when unrestricted to pass through said face and a cylindrical flange portion surrounding the exhaust portion of the siren and being spaced from the exhaust openings thereof, the cylindrical flange being formed of a mesh of apertures of variable size and/or configuration.

2. The structure as claimed in claim 1 wherein said mesh apertures in the cylindrical flange are of relatively deformed configuration.

3. The structure as claimed in claim 1 in which the screen is of drawn cup-shaped configuration where the mesh apertures of the cylindrical flange are stretched to define said variable size and/or configuration apertures.

4. The structure as claimed in claim 3 in which the floor of the cup-shaped member is formed of a mesh of relatively uniform shape and size and constitutes the face of said protective screen.

5. The structure as claimed in claim 4 in which said mesh apertures of the cylindrical flange are irregularly shaped.

6. The structure as claimed in claim 1 in which the mesh size is selected to have about 51% overall open area.

7. The structure as claimed in claim 1 wherein the screen is secured to the mounting plate of the stator.

8. The structure as claimed in claim 1 wherein the screen is secured to the stator.

9. In a siren which includes a fractional horse-power motor, plate means for mounting the motor with a shaft protruding, a perforated and vaned rotor mounted on the shaft, a perforated cup shaped stator coaxial with the shaft and rotor and having perforations around the circumference thereof and an axial opening whereby an intake orifice and plural exhaust windows are defined, air being drawn through the orifice, into the interior of the siren axially and discharged radially through the perforations; the invention comprising, a protective screen secured to the siren and having a face positioned over the intake of the stator, the face having a generally uniform mesh the size of which being selected to have openings having a diameter greater than 0.050 and less than 0.250 inches to restrict air intake but enabling at most 70% of the intake air when unrestricted to pass through said face, said screen being a drawn cup-shaped cylindrical member having in addition to said face, a cylindrical perforated flange, an annular recessed portion connecting the flange with the face with the peripheral edge of the face engaged with the stator about the intake orifice and the flange spaced uniformly outwardly of the exhaust portion of the siren and the perforations carried by the flange being of variable configuration.

10. The structure as claimed in claim 9 in which the distance between the screen flange and the cylindrical flange is selected between 0.25 and 0.375 inches.

11. The siren according to claim 9 in which the perforated flange of the screen is spaced from the exhaust portion of the siren between 0.25 and 0.375 inches.

12. A method of increasing the power output and operating efficiency of a small siren having air intake and air exhaust areas and reducing the current usage thereof comprising the steps of restricting the air intake flow axially of the siren by interposing a screen having a mesh size having openings greater than 0.050 inches and less than 0.25 inches in diameter, the screen including a portion engaging the surface of the siren about the air intake orifice thereof and restricting the flow of air through the exhaust portion of the siren by disposing a screen uniformly spaced about the circumference of the siren a predetermined distance, the mesh of the portion of the screen spaced about the circumference formed of variably shaped individual apertures while the remainder of the screen is formed of uniformly configured and sized apertures.

13. A method of increasing the power output and operating efficiency of a small siren having air intake and air exhaust areas and reducing the current usage thereof comprising the steps of restricting the air intake flow axially of the siren by interposing a screen having a mesh size having openings greater than 0.050 inches and less than 0.25 inches in diameter, the screen including an exhaust shielding area and a portion engaging the surface of the siren about the air intake orifice thereof and engaging the screen on the siren body to effect a sealed barrier between the intake and exhaust areas of the screen.

14. A siren which includes a fractional horsepower motor having a shaft, plate means mounting the motor with the shaft protruding, a perforated and vaned motor mounted on the shaft, a perforated cup-shaped stator coaxial with the shaft and rotor and having perforations around the circumference thereof and an axial opening defining an intake orifice and plural exhaust windows, said rotor capable of being driven drawing air through said orifice axially and discharging the air radially and a protective screen of drawn cup-shaped configuration having a face seated over the intake orifice, the mesh size of said screen face being selected to have openings having a diameter greater than 0.050 and less than 0.250 inches to restrict air intake but enabling at most 70% of the intake air when unrestricted to pass through said face and a cylindrical flange integral with said face and surrounding the siren exhaust and spaced from said exhaust openings, said cylindrical flange carrying variably configured apertures.

15. The siren according to claim 14 wherein said apertures on the cylindrical flange are of generally non-uniform size.

16. The siren according to claim 14 in which the face of said screen is generally uniformly perforated, an annular recessed portion connecting the cylindrical flange with the face, the peripheral edge of the face engaged sealingly with the stator and the flange spaced uniformly circumferentially outwardly of the exhaust portion of the siren.

* * * * *